US007569255B2

(12) United States Patent
Dannhauser et al.

(10) Patent No.: US 7,569,255 B2
(45) Date of Patent: Aug. 4, 2009

(54) GLOSSY INKJET RECORDING MEDIUM AND METHODS THEREFOR

(75) Inventors: Thomas J. Dannhauser, Pittsford, NY (US); Douglas E. Bugner, Rochester, NY (US); Sharon R. Girolmo, Livonia, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/855,377

(22) Filed: Sep. 14, 2007

(65) Prior Publication Data

US 2009/0074995 A1 Mar. 19, 2009

(51) Int. Cl.
*B05D 5/04* (2006.01)

(52) U.S. Cl. ..... 427/407.1

(58) Field of Classification Search ..... 427/407.1, 427/411

See application file for complete search history.

(56) References Cited

U.S. PATENT DOCUMENTS

| | | | | |
|---|---|---|---|---|
| 4,554,181 | A | 11/1985 | Cousin et al. | |
| 6,207,258 | B1 * | 3/2001 | Varnell | 428/32.1 |
| 6,335,395 | B1 * | 1/2002 | Sadasivan et al. | 524/445 |
| 6,350,507 | B1 | 2/2002 | Iwamoto et al. | |
| 6,977,100 | B2 * | 12/2005 | Kondo et al. | 428/32.25 |
| 2003/0227531 | A1 | 12/2003 | Hosoi et al. | |
| 2004/0209011 | A1 | 10/2004 | Kondo et al. | |
| 2005/0162495 | A1 * | 7/2005 | Wexler | 347/105 |

FOREIGN PATENT DOCUMENTS

| | | |
|---|---|---|
| JP | 2002-264485 | 9/2002 |
| WO | 99/03685 | 1/1999 |
| WO | 99/06219 | 2/1999 |

* cited by examiner

*Primary Examiner*—William Phillip Fletecher, III
(74) *Attorney, Agent, or Firm*—Chris P. Konkol; Arthur E. Kluegel; Andrew J. Anderson

(57) ABSTRACT

A method of manufacturing an ink-receiving medium comprising the steps of providing a support, treating the support with a salt of a multivalent metal cation, and coating upon one or each side of the support at least one porous ink-receiving top layer from an aqueous coating composition consisting of non-cationic components, wherein the non-cationic components comprise a binder and anionic particles of average particle size less than 2.5 microns, wherein the ink-receiving top layer comprises at least 50% of the total solids by weight, such that the water-soluble salt of a multivalent metal cation is able to diffuse into the ink-receiving top layer, the method further comprising drying the coating and optionally calendering the coating. Also disclosed is inkjet media made from such method and a method of printing using such inkjet media.

22 Claims, No Drawings

GLOSSY INKJET RECORDING MEDIUM AND METHODS THEREFOR

FIELD OF THE INVENTION

The invention relates generally to the field of inkjet, and in particular to glossy or semi-glossy inkjet media, its method of manufacture, and to a printing method using such media. More specifically, the invention relates to a glossy or semi-glossy inkjet recording media having an ink-receiving layer that comprises anionic particles and multivalent cationic metal salts that are a diffusion product from a support.

BACKGROUND OF THE INVENTION

The present invention is directed to overcoming the problem of printing on glossy or semi-glossy, clay-coated papers or the like with aqueous inkjet inks. Currently available glossy or semi-glossy coated papers of this kind have been engineered over the years to be compatible with conventional, analog printing technologies, such as offset lithography. The printing inks used in offset printing processes are typically very high solids, and the solvents are often non-aqueous. As a consequence, clay-based coatings that are currently used on glossy or semi-glossy printing papers, such as those used for magazines and mail order catalogs, have been intentionally designed to be resistant to the absorption of water. In fact, when these papers are characterized by standard tests as to their porosity and/or permeability, they have been found to be essentially impermeable. When such clay-coated papers are printed with inkjet inks that comprise as much as 90-95% water as the carrier solvent, the inks have a tendency to sit on the surface of the clay coating, rather than penetrate into the coating and/or underlying paper substrate.

Because the inks must dry primarily by evaporation of the water without any significant penetration or absorption of the water into the coating or paper, a number of problems are encountered. One such problem is that the individual ink droplets slowly spread laterally across the surface of the coating, eventually touching and coalescing with adjacent ink droplets. This gives rise to a visual image quality artifact known as "coalescence" or "puddling." Another problem encountered when inks dry too slowly is that when two different color inks are printed next to each other, such as when black text is highlighted or surrounded by yellow ink, the two colors tend to bleed into one another, resulting in a defect known as "intercolor bleed." Yet another problem is that when printing at high speed, either in a sheet fed printing process, or in a roll-to-roll printing process, the printed image is not dried sufficiently before the printed image comes in contact with an unprinted surface, and ink is transferred from the printed area to the unpainted surface, resulting in "ink retransfer."

Such problems have been solved in the prior art by the use of ink-receiving, layers that are porous and/or permeable to the ink. However, such coated papers are generally not suitable for high-speed inkjet printing applications for a number of reasons. In general, the glossy or semi-glossy, coated papers suitable for slower, desktop consumer inkjet printing applications, such as digital photography, are too expensive for high-speed inkjet commercial printing applications, such as magazines, brochures, catalogs, and the like. This is because such coated papers require either expensive materials, such as fumed oxides of silica or alumina, to produce a glossy surface or very thick coatings to adequately absorb the relatively heavy ink coverage required to print high quality photographs. Such coated papers may also employ cationic additives, which result in coating, formulations that are incompatible with the fluid delivery systems employed by low-cost, high-speed coating technologies used for offset printing grades.

Multivalent metal salts are known to improve the print density and uniformity of images formed on plain papers from inkjet printers. For example, Cousin, et al., in U.S. Pat. No. 4,554,181, disclose the combination of a water-soluble salt of a polyvalent metal ion and a cationic polymer for improving the print density of images printed by inkjet printers employing anionic dye-based inks. Varnell, in U.S. Pat. No. 6,207,258, discloses the use of water-soluble salts of multivalent metal ions to improve the print density and uniformity of images formed on plain papers from inkjet printers employing pigment colorants in the ink set.

Plain paper is not glossy, and traditional glossy papers for lithographic and offset printing have overcoated paper with inorganic particles such as calcium carbonate, kaolin clay, and titanium dioxide to improve smoothness and gloss. However, these inorganic pigments have a net anionic charge, and the addition of multivalent cations to a coating solution containing these anionic pigment particles will lead to agglomeration of the particles and loss of coating gloss. The coating pigments could be made compatible with the metal salts by dispersing them with a cationic dispersant (such as p-DADMAC or poly(dimethylamine)-co-epichlorohydrin), but the resulting cationic coating solution is undesired by most paper manufacturers and coaters due to the potential for contamination and interaction with the anionic coating solutions normally present in these manufacturing facilities. A changeover procedure for thorough cleaning, between coating events would be too time-consuming and costly to allow a coating composition containing a cationic component to be used.

Japanese patent application publication JP 2002-264485 discloses an inkjet recording paper with one ink-receiving layer containing a white pigment and a binder coated on a support that contains a water-soluble salt of a polyvalent metal ion. However, the coating composition for the ink-receiving layer also contains, a cationic resin, which is not compatible with anionic coating compositions that may be employed on the same manufacturing equipment. U.S. Pat. No. 6,350,507 to Iwamoto, et al., discloses coating compositions of either anionic silica or cationic alumina combined with cationic resins and water-soluble salts of divalent metals. A gloss-adjusting layer preferably containing colloidal silica is coated or laminated above the ink-receiving layer to obtain a 60-degree gloss of over 10 Gardner units. A single-layer product with acceptable gloss is more desirable. U.S. Pat. No. 6,977,100 to Kondo, et al., discloses coating compositions for an image-receiving layer containing silica, a water-soluble salt of a divalent metal ion, and a polymeric dye-fixing agent comprising cationic moieties, and intended for printing with pigment-based inks. These compositions are not compatible with anionic coating compositions.

It is therefore a primary objective of this invention to enable the manufacture of low-cost, glossy or semi-glossy coated inkjet media that exhibit sufficient porosity and/or permeability such that when said media are printed at high speed using aqueous inkjet inks, the aforementioned defects are reduced or eliminated from the printed images, but which media can be made using anionic coating compositions that are compatible with other anionic coating compositions and which media can be manufactured without risk of adverse interactions with cationic materials in the supply lines during manufacture of the media.

SUMMARY OF THE INVENTION

The present invention is directed to overcoming one or more of the problems set forth above. Briefly summarized, according to one aspect of the present invention, a glossy or semi-glossy media for use with aqueous inkjet printers in which at least one, preferably a single, ink-receiving layer that is the topcoat of the media and has no components with net cationic charge is coated over a support in or on which a water-soluble multivalent metal salt has been introduced.

The coating composition for the topcoat and method of manufacture described herein provide a way to incorporate metal salts in a simple, low-cost inkjet media made with a coating composition that is non-cationic.

In particular, the present invention is directed to a method of manufacturing an ink-receiving medium comprising the steps of:

(a) introducing into or onto a support a composition comprising a water-soluble salt of a multivalent metal cation, optionally with a binder;

(b) coating upon one or each side of the support at least one porous ink-receiving layer, a top layer, from an aqueous coating composition consisting essentially of non-cationic components, wherein the non-cationic components comprise a binder and anionic particles of average particle size less than 2.5 micrometers, wherein the anionic particles comprise at least 50% of the total solids by weight, such that the water-soluble salt of a multivalent metal cation is able to diffuse into the ink-receiving layer;

(c) drying the coating; and (d) optionally calendering the coating.

The water-soluble salt of a multivalent metal cation is suitably and effectively colorless for its intended use in white paper or the like and non-reactive with the material of the support such that its desired diffusion is not substantially prevented.

Another aspect of the invention is directed to an inkjet receiver manufactured by the above-described method. In particular, the inkjet receiver comprises:

(a) a support comprising a water-soluble, essentially colorless, non-reactive, preferably non-toxic, salt of a multivalent metal cation on its surface or, if the support is porous, on its surface and/or within its porous material;

(b) on one or each side of the support at least one porous ink-receiving top layer consisting essentially of non-cationic components comprising a binder and anionic particles of average particle size less than 2.5 micrometers, wherein the anionic particles comprise at least 50% of the total solids by weight, the layer further comprising the same water-soluble salt of a multivalent metal cation that in substantial part has diffused into the at least one porous ink-receiving layer from the support.

Finally, another aspect of the present invention is directed to a method of printing in which the above-described receiver is printed with an inkjet printer employing at least one pigment-based colorant in an aqueous ink composition.

The present invention has the following advantages. First, by avoiding use of components in the coating composition with net cationic charge, the resulting coating composition is more compatible with existing coating manufacturing operations and reduces or eliminates the need for any special handling procedures. Secondly, the resulting paper is glossy or semi-glossy after smoothing or calendering. Thirdly, by choosing component materials and formulas for coating compositions that are compatible with existing large-scale paper manufacturing and coating processes, the resulting inkjet paper is inexpensive to manufacture. The paper of the invention has greatly improved density and uniformity of prints made with inkjet printers employing aqueous inks comprising pigment-based colorants. It is also less susceptible to ink retransfer when printed in a high speed printing process.

DETAILED DESCRIPTION OF THE INVENTION

The invention provides an inexpensive glossy or semi-glossy receiver intended for use in inkjet printers employing aqueous pigment-based inks suitable for commercial high-speed printing as discussed below. The method of manufacture of the receiver or media comprises the steps of providing a support, preferably a porous support, incorporating in and/or on the support a water-soluble salt of a multivalent metal cation, coating at least one, preferably a single, image-receiving layer (IRL) from an aqueous coating composition consisting of non-cationic components, including a binder and at least 50% by weight of anionic particles, preferably clay, with an average size less than 2.5 micron, drying the coating and optionally calendering the coating.

Strict exclusion of cationic moieties from the IRL coating formula allows low-cost coating using conventional paper-coating machines that are set up to coat anionic compositions. Although the exact mechanism is unknown, it is believed that during the coating of the IRL, the multivalent metal cation in the support diffuses into the IRL to provide a fixing agent for the aqueous dispersions of ink pigments.

In a preferred embodiment, the process of manufacture comprises the step, of providing a porous support or intermediate material in the manufacture of the porous support, which support may or may not be calendered prior to coating, and treating the porous support or material with a water-soluble ("water-soluble" herein defined as at least 0.5 g dissolves in 100 ml water at 20° C.) essentially colorless, non-reactive, preferably non-toxic, salt of a multivalent metal cation.

In a preferred embodiment, the porous support is raw paper, for example, usually about 4-5 mil thick (100 micrometers). The support can alternatively be a porous synthetic polymeric material, for example, a porous extruded polyester or poly(lactic acid). The support used in the invention can be any of those usually used for inkjet receivers, such as resin-coated paper, paper, polyesters, or microporous materials such as polyethylene polymer-containing material sold by PPG Industries, Inc., Pittsburgh, Pa. under the trade name of TESLIN, TYVEK synthetic paper (DuPont Corp.), and OPPALYTE films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates.

Biaxially oriented support laminates are described in U.S. Pat. Nos. 5,853,965, 5,866,282, 5,874,205, 5,888,643, 5,888,681, 5,888,683, and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The kind of paper supports listed above include a broad range of papers, from high end papers, such as photographic paper to low end papers, such as the kind used for newsprint. In a preferred embodiment, commercial offset-grade paper is used.

Application of the salt in the size press of the paper machine is one way in which the invention can be accomplished. The dry laydown of the salt preferably ranges from 0.1 to 5 g/m$^2$ per side.

The multivalent metal salt can be applied as part of the paper manufacturing process. For example, the salt of the multivalent metal cation is incorporated by means of a size press during the paper manufacturing process. Alternatively, the porous support can be treated with the multivalent metal salt after the porous support is manufactured. For example, the salt of the multivalent metal cation can be applied to the surface of the porous support after the size press, for example, it can be applied in an aqueous carrier and sprayed or applied by gravure, blade, rod, etc.

In the instance of a surface application, in particular to a non-porous support, the composition may include a polymeric binder.

In the case of a paper support, the salt of the multivalent metal cation can be applied to the porous support in line with the manufacture of the porous support, prior to or after the final drying step of the manufacture.

In a preferred embodiment of the invention, the multivalent metal is a divalent or trivalent cation. More preferably, the multivalent metal salt is a cation selected from $Mg^{+2}$, $Ca^{+2}$, $Ba^{+2}$, $Zn^{+2}$, and $Al^{+3}$, most preferably $Ca^{+2}$ or $Mg^{+2}$ in combination with suitable counter ions.

Examples of the salt used in the invention include (but are not limited to) calcium chloride, calcium acetate, calcium nitrate, magnesium chloride, magnesium acetate, magnesium nitrate, magnesium sulfate, barium chloride, barium nitrate, zinc chloride, zinc nitrate, aluminum chloride, aluminum hydroxychloride, and aluminum nitrate. Similar salts will be appreciated by the skilled artisan. Particularly preferred salts are $CaCl_2$, $MgCl_2$, $MgSO_4$, $Ca(NO_3)_2$, or $Mg(NO_3)_2$, including hydrated versions of these salts. Combinations of the salts described above may also be used.

Preferably, the salt is applied to both sides of the paper base.

In the manufacturing method of the present invention, the multivalent metal salt is used in an amount of at least 0.1 g/m$^2$, more preferably at least 0.5 g/m$^2$, most preferably at least 1.0 g/m$^2$ to one or both sides of the support.

In a subsequent step of the manufacturing method, upon one or each side of the support, at least one porous ink-receiving top layer is coated employing an aqueous coating composition consisting essentially of non-cationic components. In other words, the composition does not include any materials characterized by a positive zeta potential at coating pH. Such materials will include multivalent cations or molecular species with a plurality of cationic sites, such as cationic polymers, latexes, or particles. The term "consisting essentially" is defined herein as the amount of cationic species added to the coating composition, whether intentionally or inadvertently, is insufficient to interact with the anionic pigments to cause a significant change in viscosity or coating particle size distribution relative to those of a coating composition in which these cationic materials were omitted. Such a change would be indicative of the potential to interact, agglomerate, or precipitate with a residual solution in the coating manufacturing machinery.

An anionic particle of the invention is defined as a particle with a negative charge as readily measured by a zeta potential. U.S. Pat. No. 7,015,270 describes conventional measurements of the zeta potential of inorganic particles used in porous layers of an inkjet recording medium, which description is hereby incorporated by reference. For the present invention, a suitable anionic particle has a zeta potential less than negative 15 mV. For example the measured zeta potential of kaolin clay (HG-90, Huber) is −24 mV.

The non-cationic components comprise a binder and anionic particles, such as clay, of average particle size less than 2.5 microns, preferably less than 1.0 micron, wherein the anionic particles comprise at least 50% of the total solids by weight. The average particle size of the anionic particle is more preferably 0.1 to 1.0 micrometer, most preferably 0.2 to 0.5 micrometer. The anionic particles can include for example, kaolin clay, delaminated kaolin clay, calcium carbonate, calcined clay, silica gel, fumed silica, talc, titanium dioxide, zeolites, or organic polymeric particles such as Dow HS3000NA. The preferred anionic particle is kaolin clay.

The at least one porous ink-receiving layer, in total for one or more layers, is less than 20 g/m$^2$/side dry weight, preferably less than 10 g/m$^2$/side. Thus, the thickness of the coating or coatings on the support are much less thick than the support.

In one particularly preferred embodiment, over the support is coated a single ink-receiving layer comprising fine-grained kaolin clay (100 parts), a polyvinylalcohol binder (1.0-7.0 parts), and a compound capable of crosslinking the binder (0.0-1.0 parts), and a surfactant (0.0-10 parts), such as described in detail in the examples below.

As indicated above, to improve compatibility of the coating solution with the process equipment, no cationic materials are present in the formulation. The ink-receiving layer is applied at a dry laydown of 5-10 g/m$^2$/side. Methods of application can include blade coating, rod coating, air-knife coating, size-press (including puddle and metered size press), or hopper coating. If the ink-receiving layer is applied only to one side of the paper, it should be applied over the same side that the metal salt was incorporated. In a preferred embodiment, an ink-receiving layer is coated on both sides of the support. After drying, the resulting ink-receiving layer can be calendered to improve gloss.

The average particle size of the kaolin clay is less than 2.5 microns preferably less than 1.0 micron, and more preferably less than 0.5 microns, as mentioned above. Examples of commercially available clays include Hydragloss 90 (Huber), Polygloss 90 (Huber), and Kaofine 90 (Thiele Kaolin). The clays may be dispersed in water alone, or small quantities (less than 1% w/w clay) of anionic dispersants (e.g., Colloid 211, an anionic polyacrylate) may be added to aid the dispersion process.

In the embodiment in which clay or another anionic pigment is used in an amount of at least 50 weight percent of total solids, up to 49% of the solids in the ink-receiving layer may comprise additional pigment particles, the composition of which may include but is not restricted to calcium carbonate, talc, zeolite, silica, alumina, calcined clay, titanium dioxide, and non-cationic polymeric organic particles. The materials in the ink-receiving layer may comprise a single material or a combination of materials.

The binder in the ink-receiving layer is a polymeric binder, preferably a hydrophilic binder alone or in combination with one or more additional binders. A preferred example of a hydrophilic polymeric binder is polyvinylalcohol. Alternative hydrophilic polymeric binders may be employed alone or in combination. Suitable polymeric binders should either be neutral or anionic at the pH of the coating solution. Non-limiting examples include starch (native and modified versions), polyester resins such as Eastman AQ sulfonated polyesters, polyurethanes, polyvinyl acetates and co- and terpolymers thereof, polyacrylates and copolymers thereof, polyvinylpyrrolidones and co-polymers thereof, proteins (including gelatin, modified gelatins, casein, whey protein, and soy protein), polyethers, celluloses and their derivatives, and polyamides. Latex dispersions of hydrophobic polymers, such as styrene-butadiene co-polymers are also useful as binders in the invention.

The coating composition for the ink-receiving layer comprises 100 parts inorganic pigment and 0.5-50 parts of polymeric binder. In a particularly preferred embodiment, however, the binder of the porous ink-receiving layer comprises polyvinylalcohol in the amount of 2 to 10 parts by weight, preferably 3 to 5 parts by weight. In a preferred embodiment, the porous ink-receiving top layer is the only ink-receiving layer on the porous support.

Subsequent to coating, the coating is dried and the layer may be calendered.

In one embodiment, in which paper is used as the support, the porous irk-receiving layer may be coated as a separate coating step subsequent to the paper manufacture and incorporation of the multivalent metal salt therein. In another embodiment, the porous ink-receiving layer can be applied in line as part of the paper manufacturing process.

After drying and optionally calendering, the inkjet paper of the invention is a semi-gloss or glossy medium preferably having a specular gloss of at least 10, more preferably at least 20, when measured at 60 degrees incident to the paper surface.

Another aspect of the invention is directed to a method of printing in which the above-described receiver is printed with an inkjet printer employing at least one pigment-based colorant in an aqueous ink composition. Preferably, the pigment-based colorants are stabilized using anionic dispersants. Such dispersants can be polymeric, containing repeating sub-units, or may be monomeric in nature. The present invention is particularly advantageous for printing periodicals, newspapers, magazines, and the like. The printing method may employ a continuous high-speed commercial inkjet printer, for example, in which the printer applies colored images from at least two different print heads, preferably full-width printheads with respect to the media, in sequence in which the different colored parts of the images are registered.

One type of printing technology, commonly referred to as "continuous stream" or "continuous" inkjet printing, uses a pressurized ink source that produces a continuous stream of ink droplets. Conventional continuous inkjet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink-capturing mechanism (catcher, interceptor, gutter, etc.) and either recycled or disposed of. When print is desired, the ink droplets are not deflected and allowed to strike a print medium. Alternatively, deflected ink droplets may be allowed to strike the print media, while non-deflected ink droplets are collected in the ink capturing mechanism.

Typically, continuous inkjet printing devices are faster than droplet on demand devices and produce higher quality printed images and graphics. However, each color printed requires an individual droplet formation, deflection, and capturing system.

Examples of conventional continuous inkjet printers include U.S. Pat. No. 1,941,001 issued to Hansell on Dec. 26, 1933; U.S. Pat. No. 3,373,437 issued to Sweet et al. on Mar. 12, 1968; U.S. Pat. No. 3,416,153 issued to Hertz et al. on Oct. 6, 1963; U.S. Pat. No. 3,878,519 issued to Eaton on Apr. 15, 1975; and U.S. Pat. No. 4,346,387 issued to Hertz on Aug. 24, 1982.

A more recent development in continuous stream inkjet printing technology is disclosed in U.S. Pat. No. 6,554,410 to Jeanmaire, et al. The apparatus includes an ink-drop-forming mechanism operable to selectively create a stream of ink droplets having a plurality of volumes. Additionally, a droplet deflector having a gas source is positioned at an angle with respect to the stream of ink droplets and is operable to interact with the stream of droplets in order to separate droplets having one volume from ink droplets having other volumes. One stream of ink droplets is directed to strike a print medium and the other is directed to an ink catcher mechanism.

EXAMPLES

The paper base used for all parts was DataSpeed Laser MOCR paper (International Paper). To help control curl, a water wash (20 ml/m$^2$) was applied to the backside of the paper base.

Example 1

A portion of paper base was coated with an aqueous solution of $CaCl_2.2H_2O$ to give 0.5 g/m$^2$ final dry salt laydown. Portions of the untreated and treated base paper were coated with an aqueous coating solution (25% total solids) comprising 100 parts clay (HYDRAGLOSS 90, Huber), 2.5 parts modified polyvinyl alcohol (GOHSEFIMER Z410®, Nippon Gohsei), 0.25 parts CARTABOND TSI crosslinker (Clariant), and 2 parts 10G surfactant (Olin). The dry laydown of the coating was 5 g/m$^2$. The coated and dried samples then were calendered. The four samples were printed with a target image comprising primary color (cyan, magenta, and yellow) patches and secondary color (red, green, blue) patches with a KODAK EASYSHARE 5500 inkjet printer, employing Kodak pigment-based inks. The average print densities of the primary and secondary patches are listed in Table 1 below.

Print non-uniformity, hereinafter "mottle," is defined as a visually apparent variation in observed color density in a print area intended to be uniform. Coalescence, the unwanted merging of non-adsorbed drops at the receiver surface in severe cases resembles mottle in that large patches of non-uniform density are apparent. In cases of less severe coalescence, the defect takes on the character of fine "grainy" non-uniformity. For purposes of evaluation of the present experimental results, all non-uniformities, regardless of their source or relative size, were combined in the evaluation. Mottle was visually evaluated and assigned a level according to the following scale:

5—severe

4—poor

3—easily visible—unacceptable

2—slight—acceptable

1—perfectly uniform

TABLE 1

| Base | IRL | Average Density (CMY) | Average Density (RGB) | Calendered | 60° Gloss | Mottle |
|---|---|---|---|---|---|---|
| Plain | None | 0.78 | 0.71 | No | 3.6 | 3 |
| Treated | None | 0.94 | 0.89 | No | 3.7 | 2 |
| Plain | Clay | 1.03 | 0.93 | Yes | 22.4 | 4 |
| Treated | Clay | 1.13 | 1.10 | Yes | 25.2 | 1.5 |

Compared with a plain paper, the salt-treated paper showed higher print density and decreased mottle, but gloss was very low. The clay-coated plain paper provided a high gloss level compared to uncoated plain paper, but mottle was exacerbated. When the clay coating was applied to the salt-treated paper, the resulting print had high gloss and print density and significantly reduced mottle.

Example 2

Various salts (ACS reagent grade unless otherwise specified) were individually coated as aqueous solutions on the front side of the paper base as described in Table 2 below. The amount of $CaCl_2.2H_2O$ coated was 1.1 g/m$^2$. The other salts were coated at equal molar amounts based on the metal ion. The ink-receiving layer consisted of 100 parts fine-grained kaolin clay (HYDRAGLOSS 90, Huber) dispersed in water at 50% solids. To this was added 2.5 parts Z-410 acetylacetonate-modified polyvinyl alcohol (Nippon Gohsei), 0.25 parts CARTABOND TSI cross-linker (Clariant), 2 parts 10G surfactant, and water to adjust the final solids to 25%. The ink-receiving layer was coated using an extrusion hopper to an aim laydown of 10 g/m$^2$ dry solids over each of the bases described. After drying, each coating was calendered to improve gloss. All samples achieved 60 degree gloss levels greater than 30.

The samples were printed on a KODAK EASYSHARE 5500 inkjet printer using the plain paper normal print mode. In addition, a sample of the uncoated paper base (uncalendered) was also printed. The image target included varying densities of cyan, magenta, yellow, red, green, blue, and black colors, as well as a practical photographic image. The status A reflection density of all colors at maximum ink laydown was measured and the average of the densities for the red, green, and blue patches was reported. The mottle of the entire print was visually judged and assigned a ranking according to the procedure of Example 1. The results are summarized in Table 2 below.

TABLE 2

| Base | Salt | Coating | Average Density (CMY) | Average Density (RGB) | Mottle | Invention/Comparison |
|---|---|---|---|---|---|---|
| A | $CaCl_2$•$2H_2O$ | Yes | 1.28 | 1.24 | 1.5 | Inv |
| B | NaCl | Yes | 1.34 | 1.25 | 3.0 | Comp |
| C | $AlCl_3$•$6H_2O$ | Yes | 1.31 | 1.25 | 1.5 | Inv |
| D | $Al_2(OH)_5Cl$* | Yes | 1.38 | 1.34 | 2.0 | Inv |
| E | $MgSO_4$ | Yes | 1.42 | 1.32 | 2.0 | Inv |
| F | $Al_2(SO_4)_3$•$18H_2O$ | Yes | 1.38 | 1.30 | 4.0 | Comp |
| G | $MgCl_2$•$6H_2O$ | Yes | 1.39 | 1.29 | 2.0 | Inv |
| H | None | Yes | 1.25 | 1.13 | 3.0 | Comp |
| I | None | No | 0.80 | 0.72 | 2.0 | Comp |

*SYLOJET A-200 (Grace Davison)

The presence of the ink-receiving layer (example 2-H) significantly improves the density of the prints made on the paper, but the print uniformity is unacceptable. However, when the ink-receiving layer is coated over paper containing multivalent metal salts, the uniformity of the printed areas is significantly improved. Salts of monovalent metal cations such as NaCl do not improve print uniformity relative to the receiving layer coated over paper base without added metal salt. The poor uniformity obtained with paper treated with aluminum sulfate is attributed to the reactivity of the salt with the cellulose and starch components in the paper itself (aluminum sulfate, or cake alum, is used to size paper); the aluminum sulfate is thus unavailable to interact with the ink at the surface of the clay coating.

Example 3

Coating compositions comprising a variety of pigments were prepared for coating on plain base paper and on base paper treated with 1.5 g/m$^2$ $MgCl_2$-$2H_2O$ salt. The coating formula was adjusted according to the pigment type by estimating and using the minimum amount of binder required assuring good coating quality. A summary of the different coating formulations is in Table 3 below. All the coatings incorporated CARTABOND TSI crosslinker (Clariant, added at 10% w/w binder polymer) and surfactant 10G (Olin, 2 parts surfactant per 100 parts pigment). The Z-410 and KH-20 binders are products of Nippon Gohsei. The samples were printed and evaluated as in Example 1 and the results shown in Table 4 below.

TABLE 3

| Pigment type | Trademarked Name of Pigment | PVA binder Trademarked Name | Parts binder/100 parts pigment |
|---|---|---|---|
| $CaCO_3$ | Albacar HO (Specialty Minerals) | KH-20 | 5 |
| $CaCO_3$ | Albaglos S (Specialty Minerals) | KH-20 | 5 |
| Kaolin clay | HG 90 (Huber) | Z-410 | 2.5 |
| Calcined Clay | 2000C (Huber) | Z-410 | 2.5 |
| Silica Gel | IJ 624 (Ineos) | KH-20 | 35 |
| Colloidal Silica | Nalco 2329 (Nalco) | KH-20 | 5 |
| Industrial Talc | NYTAL 7700 (Vanderbilt) | KH-20 | 5 |
| $CaCO_3$ | Omyajet C4440 (Omya) | KH-20 | 5 |
| Fumed silica | PG001 (Cabot) | KH-20 | 10 |
| Silica gel | Sylojet 733A (Grace Davison) | KH-20 | 35 |

TABLE 4

| IRL Pigment Type | Trademarked Name | Median Particle Size (micron) | Paper Base | 60° gloss | Average Density (CMY) | Average Density (RGB) | Mottle |
|---|---|---|---|---|---|---|---|
| none | None | N/A | plain | 3.9 | 0.80 | 0.72 | 2 |
| $CaCO_3$ | Albacar HO | 1.3 | plain | 19 | 0.80 | 0.71 | 3.5 |
| | | | treated | 15.7 | 0.97 | 0.95 | 2.5 |
| $CaCO_3$ | Albaglos S | 0.6 | plain | 14.4 | 0.91 | 0.88 | 3 |
| | | | treated | 13.3 | 1.03 | 1.03 | 2.5 |
| Kaolin | HG 90 | 0.4 | plain | 32.2 | 1.25 | 1.13 | 3 |
| | | | treated | 33.1 | 1.39 | 1.29 | 2 |
| Calcined Clay | Huber 2000C | 1.5 | plain | 13.7 | 0.76 | 0.70 | 2.5 |
| | | | treated | 13.7 | 0.94 | 0.92 | 2.5 |
| Silica Gel | IJ 624 | 3.5 | plain | 3.9 | 1.10 | 1.00 | 2.5 |
| | | | treated | 3.8 | 1.08 | 1.00 | 1 |
| Colloidal Silica | Nalco 2329 | 0.08 | plain | 20 | 1.15 | 1.13 | 4 |
| | | | treated | 22.2 | 1.30 | 1.22 | 1.5 |
| Talc | NYTAL 7700 | 2.7 | plain | 9.8 | 0.87 | 0.78 | 1 |
| | | | treated | 9.4 | 1.01 | 0.98 | 1.5 |
| | | | treated | 16.8 | 1.07 | 1.06 | 1.5 |
| $CaCO_3$ | Omyajet C4440 | 2.4 | plain | 19.3 | 1.11 | 1.07 | 2 |
| | | | treated | 26.3 | 1.14 | 1.15 | 1.5 |
| Fumed silica | PG001 | 0.2 | plain | 17.3 | 1.30 | 1.18 | 1.5 |
| | | | treated | 20.9 | 1.37 | 1.27 | 1.5 |
| Silica gel | Sylojet 733A | 0.3 | plain | 14.2 | 1.16 | 1.09 | 4 |
| | | | treated | 12.1 | 1.17 | 1.20 | 1 |

The fine-grained kaolin clay HG 90, the colloidal silica NALCO 2329 and the internally porous clay OMYAJET C4440 provided the best combination of gloss, color density and very low mottle.

The invention has been described with reference to a preferred embodiment. However, it will be appreciated that variations and modifications can be effected by a person of ordinary skill in the art without departing from the scope of the invention.

The invention claimed is:

1. A method of manufacturing an inkjet-receiving medium comprising the steps of:

(a) providing a support or intermediate material in the manufacture of the support;

(b) treating the support or intermediate material with an aqueous solution of a water-soluble, essentially colorless, non-reactive salt of a multivalent metal cation;

(c) coating upon one or each side of the treated support at least one porous ink-receiving layer, including a porous ink-receiving top layer, where each porous ink-receiving layer coated on the treated support is coated from an aqueous coating composition consisting essentially of non-cationic components, such that the aqueous coating composition is anionic at the coating pH;

wherein non-cationic components comprise binder and anionic particles of average particle size less than 2.5 micrometers, and wherein the anionic particles comprise at least 50% of total solids by weight of the porous ink-receiving top layer, such that the water-soluble salt of a multivalent metal cation diffuses into the at least one porous ink-receiving layer;

(d) drying the coating; and (e) optionally calendering the coating.

2. The method of claim 1 in which the support is porous.

3. The method of claim 2 in which the porous support comprises paper.

4. The method of claim 1 in which the anionic particles are selected from the group consisting of kaolin clay, calcium carbonate, calcined clay, silica gel, colloidal silica, fumed silica, talc, zeolites, and titanium dioxide.

5. The method of claim 4 in which the anionic particles are kaolin clay.

6. The method of claim 5 in which the aqueous coating composition further comprises up to 49 percent by weight of one or more further anionic particles selected from the group consisting of calcium carbonate, zeolite, silica, alumina, talc, calcined clay, titanium dioxide, and polymeric organic particles.

7. The method of claim 3 in which the salt of a multivalent metal cation is applied as part of the paper manufacturing process.

8. The method of claim 3 in which the salt of the multivalent metal cation is incorporated into the support by means of a size press during the manufacture of the paper.

9. The method of claim 2 in which the porous support is treated with the salt of the multivalent metal cation after the porous support is manufactured.

10. The method of claim 1 in which the porous ink-receiving top layer comprises 100 parts inorganic pigment and 0.5 to 50 parts of polymeric binder and wherein the binder comprises hydrophilic binder alone or in combination with hydrophobic binder.

11. The method of claim 10 in which the binder of the porous ink-receiving layer comprises poly (vinyl alcohol) or modified poly(vinyl alcohol) in the amount of 2 to 10 percent by weight of the porous ink-receiving top layer.

12. The method of claim 1 in which the multivalent metal cation is a divalent or trivalent cation.

13. The method of claim 1 in which the multivalent metal cation comprises a cation selected from the group consisting of $Mg^{+2}$, $Ca^{+2}$, $Zn^{+2}$, $Ba^{+2}$, and $Al^{+3}$ that forms a salt with an inorganic or organic counter ion.

14. The method of claim 1 in which the salt of the multivalent metal cation is selected from the group consisting of $CaCl_2$, $MgCl_2$, $MgSO_4$, $Ca(NO_3)_2$, $Mg(NO_3)_2$, $ZnCl_2$, $Zn(NO_3)_2$, $AlCl_3$, $Al2(OH)_5Cl$, $BaCl_2$, and $Ba(NO_3)_2$ and combinations thereof.

15. The method of claim 1 in which the salt of a multivalent metal cation is applied in an amount of at least 0.10 $g/m^2$ to one or both sides of the support.

16. The method of claim 1 in which the inkjet-receiving medium that is produced is a semi-gloss or glossy medium having a specular gloss of at least 10 when measured at 60 degrees incident to the surface of the medium.

17. The method of claim 1 in which the average particle size of the anionic particles is 0.2 to 1.0 micrometer.

18. The method of claim 1 in which the at least one porous ink-receiving layer, in total for all coated layers, is less than 20 $g/m^2$ per side.

19. The method of claim 1 in which the porous ink-receiving top layer is the only porous ink-receiving layer on the support.

20. A method of manufacturing an inkjet-receiving medium comprising the steps of:

(a) providing a support or intermediate material in the manufacture of the support;

(b) treating the support or intermediate material with a water-soluble, essentially colorless, non-reactive salt of a multivalent metal cation;

(c) coating upon one or each side of the support at least one porous ink-receiving layer, including a porous ink-receiving top layer that is coated from an aqueous coating composition consisting essentially of non-cationic components, such that the aqueous coating composition is anionic at the coating PH;

wherein non-eationic components comprise binder and anionic particles of average particle size less than 2.5 micrometers, wherein the anionic particles comprise at least 50% of total solids by weight of the porous ink-receiving top layer, such that the water-soluble salt of a multivalent metal cation diffuses into the at least one porous ink-receiving layer, wherein the porous ink-receiving top layer comprises 100 parts inorganic pigment and 0.5 to 50 parts of polymeric binder, and wherein the binder comprises hydrophilic binder alone or in combination with hydrophobic binder;

(d) drying the coating; and (e) optionally calendering the coating.

21. The method of claim 20 in which the binder of the porous ink-receiving layer comprises poly (vinyl alcohol) or modified poly(vinyl alcohol) in the amount of 2 to 10 percent by weight of the porous ink-receiving top layer.

22. A method of manufacturing an inkjet-receiving medium comprising the steps of:

(a) providing a support or intermediate material in the manufacture of the support;

(b) treating the support or intermediate material with a water-soluble, essentially colorless, non-reactive salt of a multivalent metal cation;

(c) coating upon one or each side of the support a porous ink-receiving top layer that is coated from an aqueous coating composition consisting essentially of non-cationic components, such that the aqueous coating composition is anionic at the coating pH;

wherein the porous ink-receiving top layer on one or each side of the support is the only porous ink-receiving layer on a side of the support, and the non-cationic components comprise binder and anionic particles of average particle size less than 2.5 micrometers, wherein the anionic particles comprise at least 50% of total solids by weight of the porous ink-receiving top layer, such that the water-soluble salt of a multivalent metal cation diffuses into the porous ink-receiving top layer;

(d) drying the coating; and (e) optionally calendering the coating.

* * * * *

UNITED STATES PATENT AND TRADEMARK OFFICE

CERTIFICATE OF CORRECTION

PATENT NO. : 7,569,255 B2
APPLICATION NO. : 11/855377
DATED : August 4, 2009
INVENTOR(S) : Thomas J. Dannhauser et al.

It is certified that error appears in the above-identified patent and that said Letters Patent is hereby corrected as shown below:

Column 13, claim 14, line 4, delete "Al2" and insert -- $Al_2$ --.

Column 13, claim 20, line 33, delete "PH" and insert -- pH --.

Column 13, claim 20, line 34, delete "non-eationic" and insert -- non-cationic --.

Signed and Sealed this

Thirteenth Day of October, 2009

David J. Kappos

David J. Kappos
*Director of the United States Patent and Trademark Office*